United States Patent [19]

Roberts

[11] 4,037,993

[45] July 26, 1977

[54] CONTROL SYSTEM FOR VARIABLE DISPLACEMENT COMPRESSOR

[75] Inventor: Richard W. Roberts, Lombard, Ill.

[73] Assignee: Borg-Warner Corporation, Chicago, Ill.

[21] Appl. No.: 679,547

[22] Filed: Apr. 23, 1976

[51] Int. Cl.[2] ..... F04B 1/26

[52] U.S. Cl. ..... 417/222

[58] Field of Search ..... 417/222, 212, 218, 269; 91/506; 92/12.2; 74/60; 60/443, 445, 452

[56] References Cited

U.S. PATENT DOCUMENTS

| | | | |
|---|---|---|---|
| 2,299,234 | 10/1942 | Snader et al. | 417/222 |
| 2,344,517 | 3/1944 | Schnell | 74/839 |
| 2,405,006 | 7/1946 | Ashton | 417/222 |
| 2,711,135 | 6/1955 | Dunlap | 417/222 |
| 2,942,551 | 6/1960 | Thompson | 417/389 |
| 3,062,020 | 11/1962 | Heidorn | 62/196 |
| 3,552,886 | 1/1971 | Olson | 417/269 |
| 3,575,534 | 4/1971 | Leduc | 91/506 |
| 3,861,829 | 1/1975 | Roberts et al. | 417/212 |

*Primary Examiner*—Carlton R. Croyle
*Assistant Examiner*—G. P. La Pointe
*Attorney, Agent, or Firm*—Thomas B. Hunter

[57] ABSTRACT

A variable capacity wobble plate compressor including a fluid actuator for shifting the centering ball, on which the cam mechanism is supported, to effect a change in the length of stroke by varying the angle of inclination of the wobble plate with respect to the drive shaft axis. A control system automatically responds to suction pressure (or some other predetermined variable to be controlled) to operate the fluid actuator.

5 Claims, 1 Drawing Figure

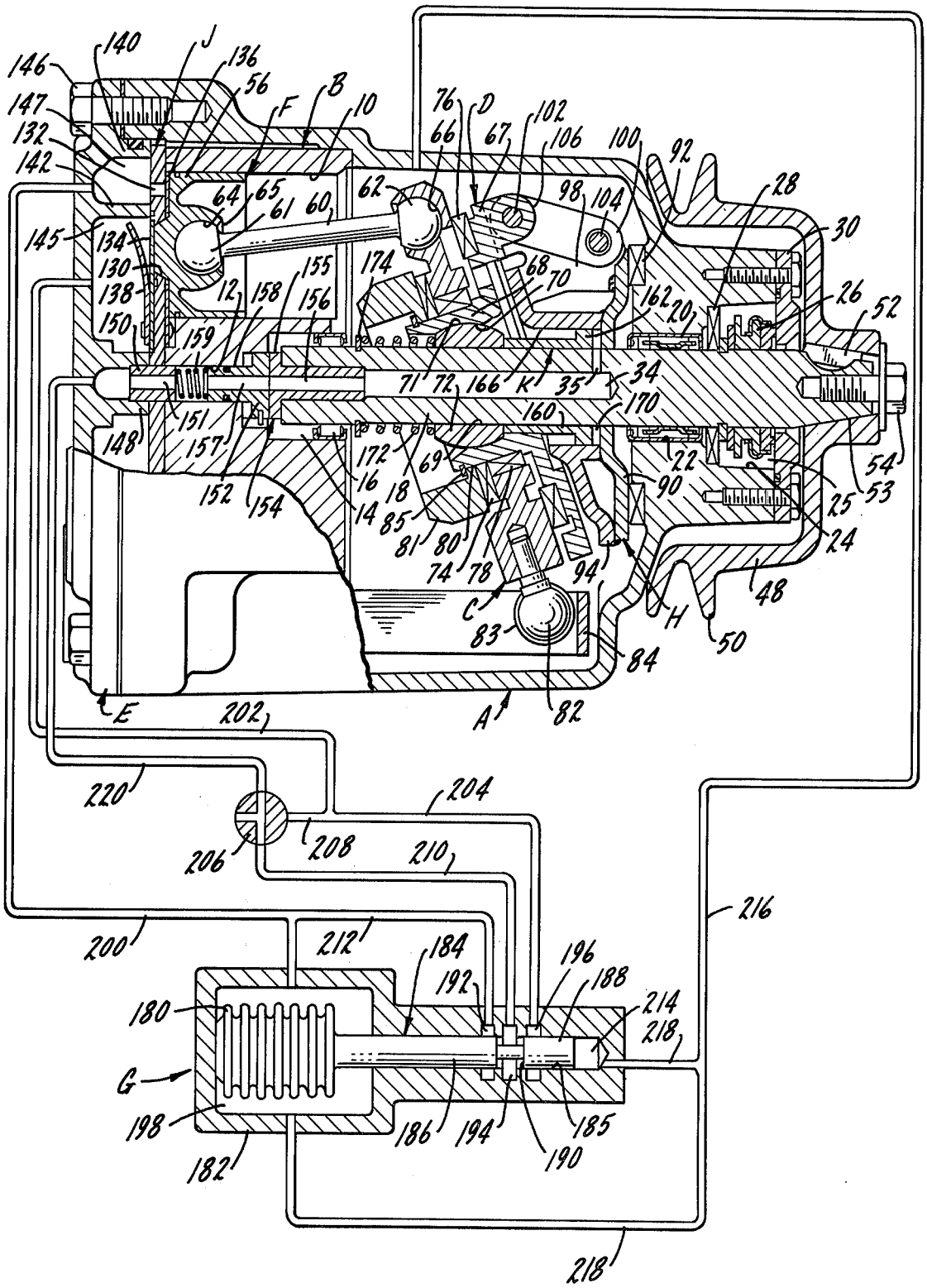
146
140
J
136
56
147
F
B
10
132
142
76
D
102
66
67
106
100
92
64
65
61
60
62
98
104
28
30
145
134
130
138
150
155
174
68
70
162
20
26
52
12
158
156
159
71
72
166
K
35
34
151
157
148
160
170
172
69
22
54
152
154
16
18
14
85
81
80
90
25
53
24
74
78
94
48
C
83
H
50
84
E
202
A
82
220
204
206
208
210
216
200
212
184
196
192
188
214
180
218
G
198
186
194
185
190
182
218

CONTROL SYSTEM FOR VARIABLE DISPLACEMENT COMPRESSOR

BACKGROUND OF THE INVENTION

1. Field of the Invention

Variable capacity wobble plate type compressors having means for changing the angle of the wobble plate to control the stroke length of the compressor.

2. Description of the Prior Art

U.S. Pat. No. 3,861,829 (Roberts et al), assigned to the same assignee as the present invention, describes a wobble plate compressor using controlled, under-piston gas pressure to vary the inclination of the wobble plate, which is supported on a universal joint. The present invention is an improvement on Roberts et al in that a fluid actuator is employed to move the wobble plate.

U.S. Pat. No. 3,552,886 (Olsen) shows a spherical bearing or hinge ball supporting the drive plate/wobble assembly to a point spaced from the drive axis to maintain essentially constant clearance volume.

U.S. Pat. No. 3,062,020 (Heidorn) discloses an automotive air conditioning compressor of the same general type as the present invention, except it contains an oil pump and relies on oil pressure to produce a stroke decreasing force on the wobble plate. During long periods of unloaded operation, the oil has a tendency to leave the compressor and excessive loss of oil causes the compresor to go into stroke until sufficient oil is returned to the compressor. Also, there are certain transient conditions when the refrigerant boils out of solution with the oil and foaming in the inlet to the pump causes loss of oil pressure. Both of these conditions may cause the compressor to operate for extended periods when air conditioning is not desired. The present invention relies on a very small minimum stroke which maintains a small pressure differential across the compressor. The discharge pressure is used to hold the wobble plate in minimum stroke.

U.S. Pat. No. 2,711,135 (Dunlap) is directed to a pump with the zero stroke condition at bottom dead center and consequently is unsuitable for a compressor. Also, this design takes the torque reaction of the wobble plate through the pistons with a wrist pin arrangement instead of a ball joint. This will cause severe edge loading, and rapid wear of the pistons and cylinder bores.

U.S. Pat. No. 2,942,551 (Thompson) shows a fuel injection system where the rim of the wobble plate bears against the ends of bellows instead of having pistons and rods. There is no necessity to anchor the outer rim against rotation in this system. Also, the stroke changing mechanism is by mechanical linkage actuated through a control rod (presumably to the accelerator pedal or some intermediate control). The mechanical design is completely different from the present invention.

U.S. Pat. No. 2,344,517 (Schnell) describes a hydraulic pump having a roller on the driving member which forces the wobble plate element to nutate. A centrally located control piston activated by discharge pressure forces the wobble plate toward the maximum stroke. A variable maximum stroke stop is controlled by centrifugal weights so that the maximum stroke reduces with increasing speed.

U.S. Pat. No. 3,575,534 (Leduc) concerns a hydraulic pump with a pivot location which maintains a more nearly constant top dead center position than centrally pivoted units, and has a centrally located control piston powered by discharge pressure to reduce the stroke. The control is designed to reduce the stroke with increasing pressure such that a constant input torque is maintained. Relatively small diameter pistons and slippers are used. The mechanical design is quite different from the present invention.

Copending applications: Abendschein et al, Ser. No. 655,799 and Close et al, Ser. No. 655,797, filed Feb. 6, 1976, disclose improvements on the Roberts et al '829 compressor; but in each of the foregoing, the pressure in the crankcase is utilized to control the position of the wobble plate by the net forces on the pistons and the leverage attributable to the pivot point being spaced from the drive shaft axis.

SUMMARY OF THE INVENTION

This invention relates generally to gas or vapor compressors and more particularly to variable cpacity wobble plate compressors including a cam mechanism for driving a wobble plate or swash plate in a nutating path and thereby causing a series of pistons to reciprocate within coacting cylinders. In order to vary the capacity, means are provided for changing the angle of the wobble plate with respect to the drive shaft axis. When the wobble plate is in a plane normal to the drive shaft axis the stroke is virtually zero and no work is performed on the gas or vapor admitted to the gas working spaces within the cylinder. As the displacement of the wobble plate from the normal plane is increased, the pistons go into stroke. Capacity can be further increased by tilting the wobble plate with respect to the plane normal to the drive axis up to some maximum limit, in practical terms something on the order of 35°–40°.

In the aforementioned Roberts et al patent, and also in the Abendschein et al and Close et al applications, pressure of the crankcase is varied in response to some variable to be controlled, such as suction pressure. Modulation of crankcase pressure thus varys the force acting on the undersides of each of the pistons which opposes the pressure of the gas acting on the top side of each piston. Under steady state conditions there will be an equilibrium position of the wobble plate resulting from these opposed forces.

While the system works quite well, it is desirable in some applications to have the crankcase at a constant pressure, preferably suction pressure. This is to insure that sufficient lubricant is maintained within the crankcase. In the present invention, a fluid actuator is substituted for the pressure regulating devices shown in the aforementioned Roberts et al patent and the Abendschein et al and Close et al patent applications. Such fluid actuator may take the form of a piston mechanism which is adapted to shift the position of the centering (or hinge) ball on which the drive plate is mounted. This will, of course, change the angularity of the wobble plate, which is mounted for relative rotation with respect to the drive plate. The fluid actuator is supplied with fluid under pressure, such as discharge gas, in response to the movement of a control valve which varies the amount of discharge gas to be made available to the piston and cylinder arrangement connected to the centering ball. A Sylphon bellows is preferably employed to actuate the control valve, said bellows being arranged within a chamber so that the exterior thereof is subjected to suction pressure.

BRIEF DESCRIPTION OF THE DRAWING

The FIGURE is a side elevation view, with substantial portions thereof broken away and shown in cross section; and the control valve for actuating the hydraulic mechanism is partly shown in schematic form.

DESCRIPTION OF THE PREFERRED EMBODIMENT

For purposes of this description, the compressor may be regarded as being organized in a plurality of subassemblies. The mechanical parts are all disposed within a housing A which is generally cylindrical in cross section and is provided with continuous side walls and opposed open ends into which the working parts are received. The other major subassemblies include a cylinder block B, a wobble plate C, a drive plate D, a head assembly E, the pistons and associated connecting rods F, control valve assembly G, drive shaft assembly H, valve plate J and fluid actuator K.

As best shown in the drawing, which is fundamentally a cross section view, the cylinder block B is provided with a plurality of spaced cylinders 10. The axes of the cylinders are parallel to the drive shaft axis, but it is understood that it is possible to arrange such cylinders along nonparallel axes without departing from the principles of the invention. The number of cylinders is a matter of choice in design, although there is obviously some practical upper limit and the operation of the design shown requires at least three cylinders since the control of the wobble plate position depends on the balancing forces resulting from the geometry of the wobble plate pivot point with respect to the drive axis.

The cylinder block B also includes a centrally located axial bore 12 (as shown at the left hand side of the FIGURE). There is also a counterbore 14 which receives the rear radial bearing 16. Radial bearing 16 supports the rear end of drive shaft 18. The terms "front", "rear" etc. are of course arbitrary; but in this description the front of the compressor is the right-hand portion, and the rear of the compressor is the left-hand portion of the FIGURE.

The drive shaft 18 is supported at its front end by a front radial bearing assembly 20. The housing A is provided with a central axial bore 22 which receives the front radial bearing 20 and a counterbore 24 forming a cavity 25 adapted to accommodate a seal assembly 26 and the small thrust bearing 28. The right hand end (as viewed in the FIGURE) of the housing is closed by a seal plate 30. The drive shaft 18 has a central axial passage 34 which interconnects with a radial passage 25, used to supply fluid to the fluid actuator assembly K to be described in more detail below.

The drive shaft is driven by means of a pulley 48 having a generally bell shaped configuration and provided with V-belt engaging flanges 50. The pulley is keyed at 52 to the tapered section 53 of the drive shaft 18 and held in place by a machine screw 54 at the end thereof. Although the compressor is described as being driven by a pulley, because one principal application for the compressor is in an automotive air conditioning system driven by the accessory drive belt, it should be understood that any suitable drive means may be provided.

The piston and connecting rod assembly F includes pistons 56 connected to the wobble plate C by means of connecting rods 60, each having ball shaped enlarged sections 61, 62 at opposite ends thereof which may be captured in sockets formed respectively in the pistons and wobble plate. As viewed in the FIGURE, the left hand end 61 of each connecting rod is secured to the underside of the pistons and received within a complementary shaped socket 64 formed in a thickened portion 65 of the piston 56 at the center thereof. The opposite ball shaped end 62 of the connecting rod is received within a complementary socket 66 formed in the wobble plate C. This arrangement allows a number of degrees of freedom, in all directions, between the respective ends of the connecting rods both at the piston and at the wobble plate.

The wobble plate C is rotatably supported on the drive plate assembly D which includes an annular flange 67 extending from the drive shaft axis and an axial hub section 68 which is hollow and formed with an internal spherical surface 70 to receive the main wobble plate and drive plate bearing member, referred to herein as hinge ball 72. Hinge ball 72 is formed with a bore 69 for drive shaft 18, to allow sliding fore and aft movement thereon, and spherical surface 71 cooperating with surface 70. For a more detailed explanation of the wobble plate and drive plate construction, refer to copending application Ser. No. 655,799, Abendschein et al.

The wobble plate C is mounted for relative rotary movement with respect to the rotating drive plate assembly D by means of three sets of bearings; the rear wobble plate thrust bearing 74; the front wobble plate thrust bearing 76; and the radial wobble plate bearing 78. The inner race of the radial bearing 78 is mounted on the OD 80 of the axial hub section 68 of the drive plate assembly so that the drive plate, which acts as a cam mechanism, can rotate freely with respect to the wobble plate. In order to balance the assembly under dynamic conditions, a balance weight ring 81 of substantial mass is secured to the nose of the hub section 68 by means of retaining ring 85. The wobble plate C is restrained against rotative movement by means of anchoring ball element 82 and cooperating slippers or pads 83. When the compressor is in stroke, the anchoring ball slides back and forth within a U-shaped track 84 attached to the lower portion of the cylinder block B.

The drive shaft assembly H (sometimes referred to as the link plate) which is secured to and rotates with the drive shaft, is formed from two stampings, the first of which (shown at 90) is spaced from the inside of the housing by means of a large thrust bearing assembly 92. A second stamping 94, which is inclined with respect to the drive shaft (at the same angle as the maximum inclination provided for maximum stroke operation of the compressor) is attached to stamping 90 such as by welding. A pair of spaced apart flanges, only one of which is shown at 98, are adapted to support a pair of links (only one shown at 100) connecting the drive plate assembly D at lug 106 to the drive shaft assembly H through pins 102 and 104. The pivot construction is essentially the same as that shown in the aforementioned Abendschein et al application.

The head assembly E includes a skirt portion 140 and an interior rib 142 providing an outer suction gas chamber 147 and an inner discharge gas chamber 145. Conventional suction and discharge connections (not shown) cooperate respectively with said suction and discharge gas chambers. In an air conditioning or refrigeration application, the suction connection would be fitted to a line leading from the evaporator and the discharge connection to a line leading to the condenser.

The head is bolted, as at 146, to the rear of the housing A. A centrally located boss 148 receives a hollow dowel 150 having a passage 151 providing a portion of the path for discharge gas between the control valve assembly G and the fluid actuator mechanism K. An annular flange 152 on plug 158 constitutes the non-rotating element of a fluid seal 154, the rotating element 155 of said seal being press fitted into the end of the drive shaft 18. Spring 159 biases the non-rotating member 158 against element 155. The remaining portion of the fluid path includes a passage 156 in element 155 and passage 157 in plug 158 both aligned with passages 151 and the central passage 34 through the drive shaft.

The valve plate assembly J is interposed between the head E and cylinder block B. It includes a plurality of discharge ports 130 and suction ports 132 (only one set being shown in the drawing) with cooperating, flapper-type discharge valves 134 and suction valves 136. Suction gas is drawn in from chamber 147 through port 132 and valve 136 to the gas working space, compressed by piston 56 and then discharged through port 130 and valve 134 to the discharge gas chamber 145. A valve stop 138 limits the upward travel of discharge valve 134.

The fluid actuator K comprises a sleeve element 160 which is slidable on the drive shaft 18 and has one end engaging the hinge ball 72. The opposite end of the sleeve element has an annular, radially extending flange 162, the perimeter of which is in the sealing engagement with a cylindrical surface 166 machined on the interior of an axially extending section of stamping 94, which is a part of the drive shaft or link plate assembly H. Flange 162 thus constitutes a piston element within a cylinder, both cooperating to provide an expansible chamber 170 to which discharge gas is admitted through radial passage 35 in the drive shaft which communicates with central passage 34. A spring 172, secured by retaining ring 174, engages the opposite side of the hinge ball 72 and biases the hinge ball to the right.

The control valve G includes an evacuated, Sylphon-type bellows 180 arranged within a housing 182 and adapted to actuate a spool 184 received within bore 185. The spool is provided with first and second spaced lands 186, 188 separated by a groove 190, all associated with first, second and third ports 192, 194, 196 within the housing. The bellows is disposed within a chamber 198 which communicates with suction chamber 147 by way of passage 200. Discharge gas pressure is available at port 196 through passage 202 and 204. Discharge chamber 145 is also connected to a three way valve 206 by way of passages 202 and 208. The central port 194 is connected directly to the fluid actuator by passage 210, three way valve 206, passage 220 and passages 34 and 35 in shaft 38. The first port 192 is connected to the main suction passage 200 via line 212. The space 214 at the end of the spool 184 interconnects with the interior of the housing A by means of passage 216 while space 214 is connected to chamber 198 by passage 218.

OPERATION

With the valve 206 in the position shown, discharge gas can be supplied to the fluid actuator K through passages 202 and 204, ports 196 and 194, passage 210, valve 206, and passages 220, 151, 157, 156, 34 and 35. As suction pressure decreases, indicating a reduced load, the bellows 180 expands by virtue of the reduced pressure in chamber 198. This will cause the spool 186 to move to the right closing off flow between ports 192 and 194 and allowing discharge pressure to be communicated to the expansible chamber along the path described above. An increase in pressure within chamber 170 will shift the hinge ball to the left against the force of spring 172 and move the wobble plate to a more vertical position, reducing stroke and capacity.

Conversely, as suction pressure increases, thus indicating an increased load on the system, the increased suction pressure will be transmitted through line 200 from the suction chamber 147 in the head to the bellows chamber 198. The increased pressure in the bellows chamber will cause the bellows to contract, urging the spool to the left and closing off flow between ports 196 and 194 while opening a flow path between ports 194 and 192. This allows the pressure in the expansible chamber 170 to be relieved to suction through the following path: passages 34, 35, 156, 157, 151 and 220; three way valve 206; passage 210; ports 194 and 192; passage 212 and suction line 200. A reduction in the pressure in expansible chamber 170 will allow the spring 172 and the gas pressure forces on the pistons to shift the hinge ball to the right increasing the angle from the vertical and the stroke length.

When the compressor is to be shut down, three way valve 206 is turned to a position interconnecting passages 208 and 210. Discharge gas is then directed, regardless of the position of the spool 184, from discharge chamber 145, passages 202 and 208, valve 206 and passages 220, 151, 156, 34 and 35 to the fluid actuator. This will shift the wobble plate to substantially zero stroke, with just enough movement of the pistons to maintain a pressure differential and to keep the wobble plate in its near vertical position.

While this invention has been described in connection with a certain specific embodiment thereof, it is to be understood that this is by way of illustration and not by way of limitation; and the scope of the appended claims should be construed as broadly as the prior art will permit.

What is claimed is:

1. A variable displacement compressor comprising a plurality of cylinders and pistons cooperating to provide gas working spaces, each said cylinder having a suction and discharge port cooperating therewith; a wobble plate connected to said pistons and imparting the reciprocating force to actuate said pistons; a drive shaft; a cam mechanism driven by said drive shaft and cooperating with said wobble plate, said wobble plate and cam mechanism being pivoted at a point spaced from the drive shaft axis and movable from a position wherein said wobble plate is positioned along a plane substantially normal to said drive shaft axis to a position angularly displaced from said normal plane; a mounting element supporting said cam mechanism, and mounting element having an outer spherical surface engaging said cam mechanism and a central bore through which said drive shaft extends, said mounting element being slidable to and fro on said drive shaft as the wobble plate angle is changed; and a fluid actuator comprising a piston and cylinder arrangement in which increased pressure in said actuator cylinder causes the actuator piston to move said wobble plate in a direction toward said normal plane, reducing the stroke length of said pistons; and means for supplying high pressure gas from said gas working spaces to said actuator cylinder, said last-named means including a control valve responsive to a variable indicative of capacity requirements.

2. A compressor as defined in claim 1 wherein said control valve is responsive to suction pressure.

3. A compressor as defined in claim 1 including a valve member adapted to direct unmodulated discharge pressure to said fluid actuator to maintain said wobble plate at the minimum stroke position.

4. A compressor as defined in claim 1 wherein said actuator piston includes a sleeve portion around said drive shaft and adapted to engage said mounting element.

5. A compressor as defined in claim 4 including spring means engaging said mounting means and opposing the effort of said actuator piston when it is tending to move said wobble plate toward said normal plane.

* * * * *